US008096090B1

(12) United States Patent
Hohmann, Jr. et al.

(10) Patent No.: US 8,096,090 B1
(45) Date of Patent: Jan. 17, 2012

(54) SNAP-IN WIRE TIE

(75) Inventors: Ronald P. Hohmann, Jr., Hauppauge, NY (US); Ronald P. Hohmann, Hauppauge, NY (US)

(73) Assignee: Mitek Holdings, Inc., Wilmington, DE (US)

( * ) Notice: Subject to any disclaimer, the term of this patent is extended or adjusted under 35 U.S.C. 154(b) by 4 days.

(21) Appl. No.: 11/977,536

(22) Filed: Oct. 24, 2007

Related U.S. Application Data

(62) Division of application No. 11/199,108, filed on Aug. 8, 2005, now Pat. No. 7,325,366.

(51) Int. Cl.
*E04B 1/38* (2006.01)
*E04B 1/16* (2006.01)
*E04B 2/00* (2006.01)

(52) U.S. Cl. ..... 52/513; 52/379; 52/426

(58) Field of Classification Search ..... 52/379, 52/426, 657, 713, 513, 712, 167.1
See application file for complete search history.

(56) References Cited

U.S. PATENT DOCUMENTS

| | | | | |
|---|---|---|---|---|
| 819,869 | A | | 5/1906 | Dunlap |
| 1,794,684 | A | | 3/1931 | Handel |
| 2,780,936 | A | | 2/1957 | Hillberg |
| 3,030,670 | A | | 4/1962 | Bigelow |
| 3,277,626 | A | | 10/1966 | Brynjolfsson et al. |
| 3,341,998 | A | | 9/1967 | Lucas |
| 3,377,764 | A | | 4/1968 | Storch |
| 3,568,389 | A | | 3/1971 | Gulow |
| 4,021,990 | A | | 5/1977 | Schwalberg |
| 4,373,314 | A | | 2/1983 | Allan |
| 4,473,984 | A | | 10/1984 | Lopez |
| 4,596,102 | A | | 6/1986 | Catani et al. |
| 4,598,518 | A | | 7/1986 | Hohmann |
| 4,699,362 | A | * | 10/1987 | Krakauer ..... 267/91 |
| 4,724,557 | A | * | 2/1988 | Yates et al. ..... 5/248 |
| 4,738,070 | A | | 4/1988 | Abbott et al. |
| 4,827,684 | A | | 5/1989 | Allan |
| 4,843,776 | A | | 7/1989 | Guignard |
| 4,869,038 | A | | 9/1989 | Catani |
| 4,875,319 | A | * | 10/1989 | Hohmann ..... 52/383 |
| 4,955,172 | A | | 9/1990 | Pierson |
| 5,207,043 | A | * | 5/1993 | McGee et al. ..... 52/379 |
| 5,408,798 | A | * | 4/1995 | Hohmann ..... 52/562 |
| 5,440,854 | A | | 8/1995 | Hohmann |
| 5,454,200 | A | * | 10/1995 | Hohmann ..... 52/513 |
| 5,634,310 | A | | 6/1997 | Hohmann |
| 5,671,578 | A | | 9/1997 | Hohmann |

(Continued)

OTHER PUBLICATIONS

Building Envelope Requirements, 780 CMR, Chapter 13; Boston, MA, Jan. 1, 2001.

(Continued)

*Primary Examiner* — Eileen D Lillis
*Assistant Examiner* — Andrew Triggs
(74) *Attorney, Agent, or Firm* — Siegmar Silber, Esq.

(57) ABSTRACT

A seismic construction system for a cavity wall is disclosed. The system is shown in three exemplary applications—a masonry backup wall with ladder—or truss-type reinforcement cooperating with a snap-in wire tie; a masonry backup wall with ladder—or truss-type reinforcement with a high-span wall anchor cooperating with a low-profile, snap-in wire tie; and a drywall backup wall with internal insulation, a sheetmetal wall anchor, and snap-in wire ties. The snap-in wire ties accommodate a continuous reinforcing wire for the outer wythe, which reinforcing wire snaps into the wire housings therefor with a predetermined force. With the interconnected wall and veneer anchors and the respective reinforcing elements a seismic construct is formed.

15 Claims, 6 Drawing Sheets

U.S. PATENT DOCUMENTS

| | | | | |
|---|---|---|---|---|
| 5,816,008 | A | 10/1998 | Hohmann | |
| 6,209,281 | B1 * | 4/2001 | Rice | 52/714 |
| 6,279,283 | B1 | 8/2001 | Hohmann et al. | |
| 6,332,300 | B1 | 12/2001 | Wakai | |
| 6,351,922 | B1 | 3/2002 | Burns et al. | |
| 6,637,704 | B2 * | 10/2003 | Jette | 248/49 |
| 6,668,505 | B1 * | 12/2003 | Hohmann et al. | 52/565 |
| 6,735,915 | B1 | 5/2004 | Johnson, III | |
| 6,789,365 | B1 * | 9/2004 | Hohmann et al. | 52/565 |
| 6,851,239 | B1 * | 2/2005 | Hohmann et al. | 52/513 |
| 6,941,717 | B2 * | 9/2005 | Hohmann et al. | 52/506.01 |
| 7,017,318 | B1 * | 3/2006 | Hohmann et al. | 52/562 |
| 7,325,366 | B1 * | 2/2008 | Hohmann et al. | 52/513 |
| 2001/0054270 | A1 * | 12/2001 | Rice | 52/714 |
| 2002/0153458 | A1 * | 10/2002 | Jette | 248/49 |
| 2004/0083667 | A1 | 5/2004 | Johnson, III | 52/379 |
| 2007/0062138 | A1 * | 3/2007 | Wobber | 52/379 |
| 2008/0092472 | A1 * | 4/2008 | Doerr et al. | 52/379 |

OTHER PUBLICATIONS

Hohmann and Barnard, Catalog Sheet for Seismic Veneer Anchors, Hauppauge, NY, 2002.

* cited by examiner

FIG. 2
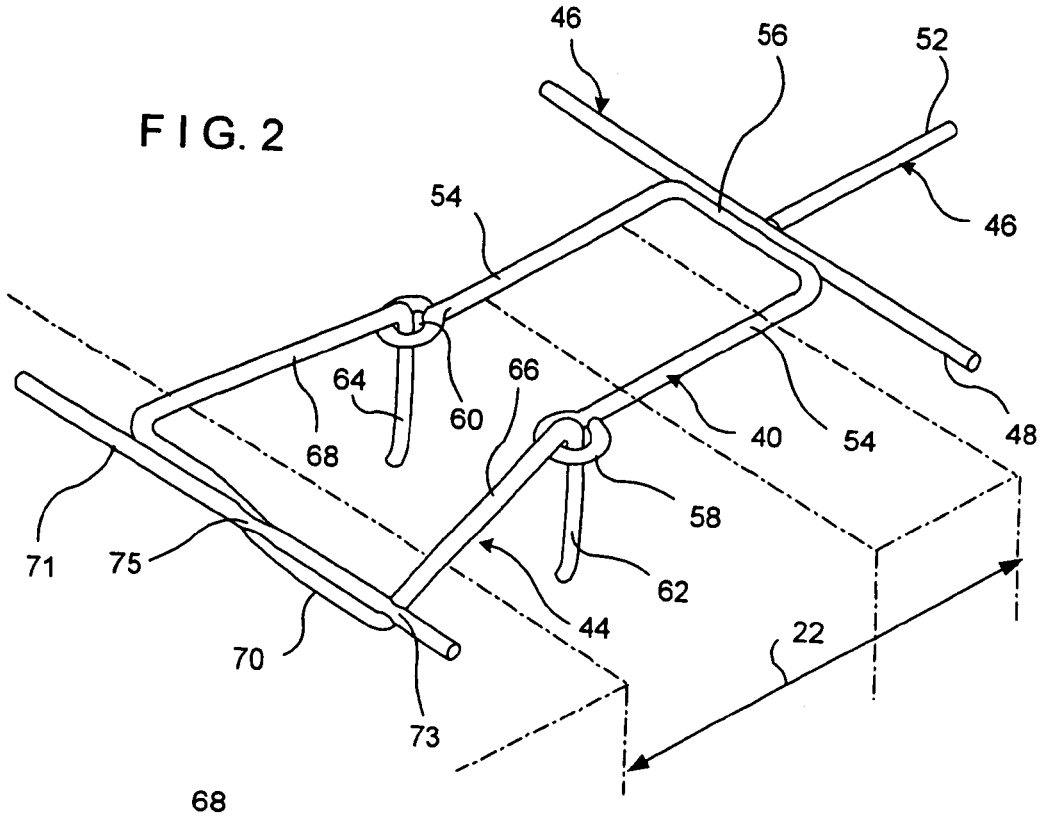
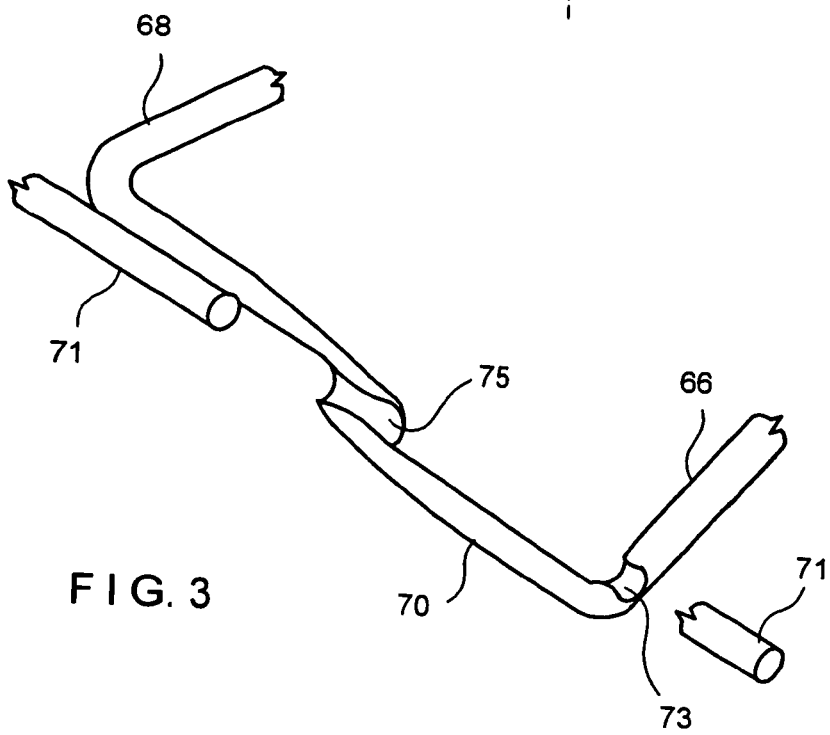
FIG. 3

SNAP-IN WIRE TIE

RELATED APPLICATION

This application is a divisional of patent application Ser. No. 11/199,108, filed Aug. 8, 2005, entitled SNAP-IN WIRE TIE, now U.S. Pat. No. 7,325,366 issued Feb. 5, 2008.

BACKGROUND OF THE INVENTION

1. Field of the Invention

This invention relates to an improved anchoring arrangement for use in conjunction with a seismic construction system for cavity walls having an inner wythe and an outer wythe. More particularly, the invention relates to construction accessory devices, namely, snap-in wire ties, for emplacement in the outer wythe. These devices accommodate the encapturing of a reinforcing wire therewithin. The invention is applicable to seismic structures having an outer wythe of brick or stone facing in combination with an inner wythe of masonry block or dry wall construction and with various forms of insulation.

2. Description of the Prior Art

In the past, investigations relating to the effects of various forces, particularly lateral forces, upon brick veneer masonry construction demonstrated the advantages of having a continuous wire embedded in the mortar joint of anchored veneer walls, such as facing brick or stone veneer. The seismic aspect of these investigations were referenced in the prior patent, namely U.S. Pat. No. 4,875,319, to Ronald P. Hohmann, an inventor hereof.

The assignee of U.S. Pat. No. 4,875,319, Hohmann & Barnard, Inc., successfully commercialized the device under the SeismiClip trademark. For many years the white plastic clip tying together the veneer anchor and the reinforcement wire in the outer wythe has been a familiar item in commercial seismic-zone buildings. There has been a long felt need to combine the clip and veneer anchor as detailed hereinbelow. The combination item reduces the number of "bits and pieces" brought to the job site and simplifies installation.

Recently, there have been significant shifts in public sector building specifications which have resulted in architects and architectural engineers requiring larger and larger cavities in the exterior cavity walls of public buildings. These requirements are imposed without corresponding decreases in wind shear and seismic resistance levels or increases in mortar bed joint height. Thus, the wall anchors needed are restricted to occupying the same ⅜-inch bed joint height in the inner and outer wythes. Thus, the veneer facing material is tied down over a span of two or more times that which had previously been experienced. Exemplary of the public sector building specification is that of the Energy Code Requirement, Boston, Mass. (See Chapter 13 of 780 CMR, Seventh Edition). This Code sets forth insulation R-values well in excess of prior editions and evokes an engineering response opting for thicker insulation and correspondingly larger cavities.

Besides earthquake protection, the failure of several high-rise buildings to withstand wind and other lateral forces has resulted in the incorporation of a requirement for continuous wire reinforcement in the Uniform Building Code provisions. The inventor's related SeismiClip®. and DW-10-X®. products (manufactured by Hohmann & Barnard, Inc., Hauppauge, N.Y. 11788) have become widely accepted in the industry. The use of a continuous wire in masonry veneer walls has also been found to provide protection against problems arising from thermal expansion and contraction and improving the uniformity of the distribution of lateral forces in a structure.

The following patents are believed to be relevant and are disclosed as being known to the inventor hereof:

| U.S. Pat. No. | Inventor | Issue Date |
|---|---|---|
| 3,377,764 | Storch | Apr. 16, 1968 |
| 4,021,990 | Schwalberg | May 10, 1977 |
| 4,373,314 | Allan | Feb. 15, 1983 |
| 4,473,984 | Lopez | Oct. 02, 1984 |
| 4,598,518 | Hohmann | Jul. 08, 1986 |
| 4,869,038 | Catani | Sep. 26, 1989 |
| 4,875,319 | Hohmann | Oct. 24, 1989 |
| 5,454,200 | Hohmann | Oct. 03, 1995 |
| 6,668,505 | Hohmann et al. | Dec. 30, 2003 |
| 6,789,365 | Hohmann et al. | Sep. 14, 2004 |
| 6,851,239 | Hohmann et al. | Feb. 08, 2005 |

It is noted that these devices are generally descriptive of wire-to-wire anchors and wall ties and have various cooperative functional relationships with straight wire runs embedded in the interior and/or exterior wythe.

U.S. Pat. No. 3,377,764-D. Storch-Issued Apr. 16, 1968 Discloses a bent wire, tie-type anchor for embedment in a facing exterior wythe engaging with a loop attached to a straight wire run in a backup interior wythe.

U.S. Pat. No. 4,021,990-B. J. Schwalberg-Issued May 10, 1977 Discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,373,314-J. A. Allan-Issued Feb. 15, 1983 Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984-Lopez-Issued Oct. 2, 1984 Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,598,518-R. Hohmann-Issued Jul. 7, 1986 Discloses a dry wall construction system with wallboard attached to the face of studs which, in turn, are attached to an inner masonry wythe. Insulation is disposed between the webs of adjacent studs.

U.S. Pat. No. 4,869,038-M. J. Catani-Issued Sep. 26, 1989 Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4,879,319-R. Hohmann-Issued Oct. 24, 1989 Discloses a seismic construction system for anchoring a facing veneer to wallboard/metal stud construction with a pronged sheetmetal anchor. Wall tie is distinguished over that of Schwalberg '990 and is clipped onto a straight wire run.

U.S. Pat. No. 5,454,200-R. Hohmann-Issued Oct. 3, 1995 Discloses a facing anchor with straight wire run and mounted along the exterior wythe to receive the open end of wire wall tie with each leg thereof being placed adjacent one side of reinforcement wire. As the eye wires hereof have scaled eyelets or loops and the open ends of the wall ties are sealed in the joints of the exterior wythes, a positive interengagement results.

U.S. Pat. No. 6,668,505-Hohmann et al.-Issued Dec. 30, 2003 Discloses high-span and high-strength anchors and reinforcement devices for cavity walls combined with interlocking veneer ties are described which utilize reinforcing wire and wire formatives to form facing anchors, truss or ladder reinforcements, and wall anchors providing wire-to-wire connections therebetween.

U.S. Pat. No. 6,789,365-R. Hohmann et al.-Issued Sep. 14, 2004 Discloses side-welded anchor and reinforcement devices for a cavity wall. The devices are combined with interlocking veneer anchors, and with veneer reinforcements to form unique anchoring systems. The components of each system are structured from reinforcing wire and wire formatives.

U.S. Pat. No. 6,851,239-Hohmann et al.-Issued Feb. 8, 2005 Discloses a high-span anchoring system described for a cavity wall incorporating a wall reinforcement combined with a wall tie which together serve a wall construct having a larger-than-normal cavity. Further the various embodiments combine wire formatives which are compressively reduced in height by the cold-working thereof. Among the embodiments is a veneer anchoring system with a low-profile wall tie for use in a heavily insulated wall.

None of the above provide a completely reinforced arrangement of both the inner and the outer wythes, and all of the above lack a simplified snap-in anchor to encapture the reinforcement wire as described hereinbelow.

SUMMARY

In general terms, the invention disclosed hereby is a seismic construction system for cavity walls having an inner and outer wythe. The system includes snap-in wire ties for emplacement in the outer wythe. The seismic construction system hereof is applicable to construction of a wall having an inner wythe which can either be of dry wall construction or masonry block and an outer wythe and to insulated and non-insulated structures. The wythes are in a spaced apart relationship and form a cavity therebetween. In the disclosed system, a unique combination of a wall anchor (attachable to either ladder- or truss-type reinforcement for masonry inner wythes or to metal studs of a dry wall construct), a snap-in wire tie, and a continuous wire reinforcement is provided. The invention contemplates that the snap-in wire ties are wire formatives with pintles depending into the wall cavity for connections between the snap-in wire tie and the wall anchor.

In the first embodiment of this invention, the inner wythe is constructed from a masonry block material, the masonry anchor is a wire formative attached to a ladder-type reinforcement in a manner similar to the wall anchor shown in Hohmann, U.S. Pat. No. 6,789,365. The eye wires thereof extend into the cavity between the wythes. Each pair of eye wires accommodates the interengagement therewith of the pintles of the snap-in wire ties.

The snap-in wire tie is then positioned so that the insertion end thereof is secured to a continuous reinforcement wire that snaps into wire housings within the snap-in wire ties. The snap-in wall tie and the continuous wire housed therein are then embedded in the bed joint of the outer wythe. The snap-in feature of the anchor here replaces the traditional function of the seismic clip for accommodating a straight wire run (see U.S. Pat. No. 4,875,319) and receiving the open end of the box tie. As the eye wires have sealed eyelets or loops with predetermined dimensions the horizontal movement of the construct is restricted accordingly.

In a second embodiment with a masonry block inner wythe, the lessons learned in forming low-profile and high-span anchoring components are incorporated herein. The familiar veneer anchor for low-profile applications with corrugated surfaces is refashioned with wire housing portions to accept in a snap-fit relationship a continuous wire reinforcement.

In another mode of practicing this invention, the inner wythe is a dry wall construct. Here, the dry-wall anchor, is a metal stamping and is attached by sheetmetal screws to the metal vertical channel members of the wall. Each dry-wall anchor accommodates in horizontally extending portions, the pintles of the wire formatives snap-in wire tie. As in the case of the masonry inner wythe, the insertion end of the wire tie is then positioned on the outer wythe so that a continuous reinforcement wire clips into and is securable to the outer wythe anchor. This anchor and a straight wire run are embedded in the bed joint of the outer wythe.

OBJECTS AND FEATURES OF THE INVENTION

It is an object of the present invention to provide in a seismic construction system having an outer wythe and an inner wythe, a snap-in wire tie anchor that interengages a wall anchor which system further includes a continuous wire reinforcement in the mortar joint of the outer wythe.

It is another object of the present invention to provide labor-saving devices to simplify seismic-type installations of brick and stone veneer and the securement thereof to an inner wythe.

It is yet another object of the present invention to provide a seismic construction system to snap together the continuous wire reinforcement in a positive manner to the adjacent wire tie.

It is a further object of the present invention to provide a snap-in wire tie construction system comprising a limited number of component parts that are economical of manufacture resulting in a relatively low unit cost.

It is yet another object of the present invention to provide a seismic construction system which restricts lateral and horizontal movements of the facing wythe with respect to the inner wythe, but is adjustable vertically.

It is a feature of the present invention that the snap-in wire tie, after being inserted into the corresponding bed joint, receives in the wire housing portions thereof a reinforcing wire.

It is another feature of the present invention that the snap-in wire ties are utilizable with either a masonry block having aligned or unaligned bed joints or for a dry wall construct that secures to metal studs.

Other objects and features of the invention will become apparent upon review of the drawings and the detailed description.

BRIEF DESCRIPTION OF THE DRAWINGS

In the following drawings, the same parts in the various views are afforded the same reference designators.

FIG. 2 is a partial perspective view of FIG. 1 showing details of the wall anchor and the veneer tie with snap-in housing for the seismic reinforcement wire;

FIG. 3 is a cross-sectional view of the snap-in housing of the veneer anchor of FIG. 2;

DESCRIPTION OF THE PREFERRED EMBODIMENTS

The description which follows is of three embodiments of the snap-in wire tie devices of this invention, which devices are suitable for cavity wall seismic applications. Two of the embodiments apply to cavity walls with masonry block inner wythes, and the third, to cavity walls with dry wall (sheetrock) inner wythes. The wall anchor of the first embodiment is adapted from that shown in U.S. Pat. No. 6,789,365 of the inventors hereof.

Figure 1:
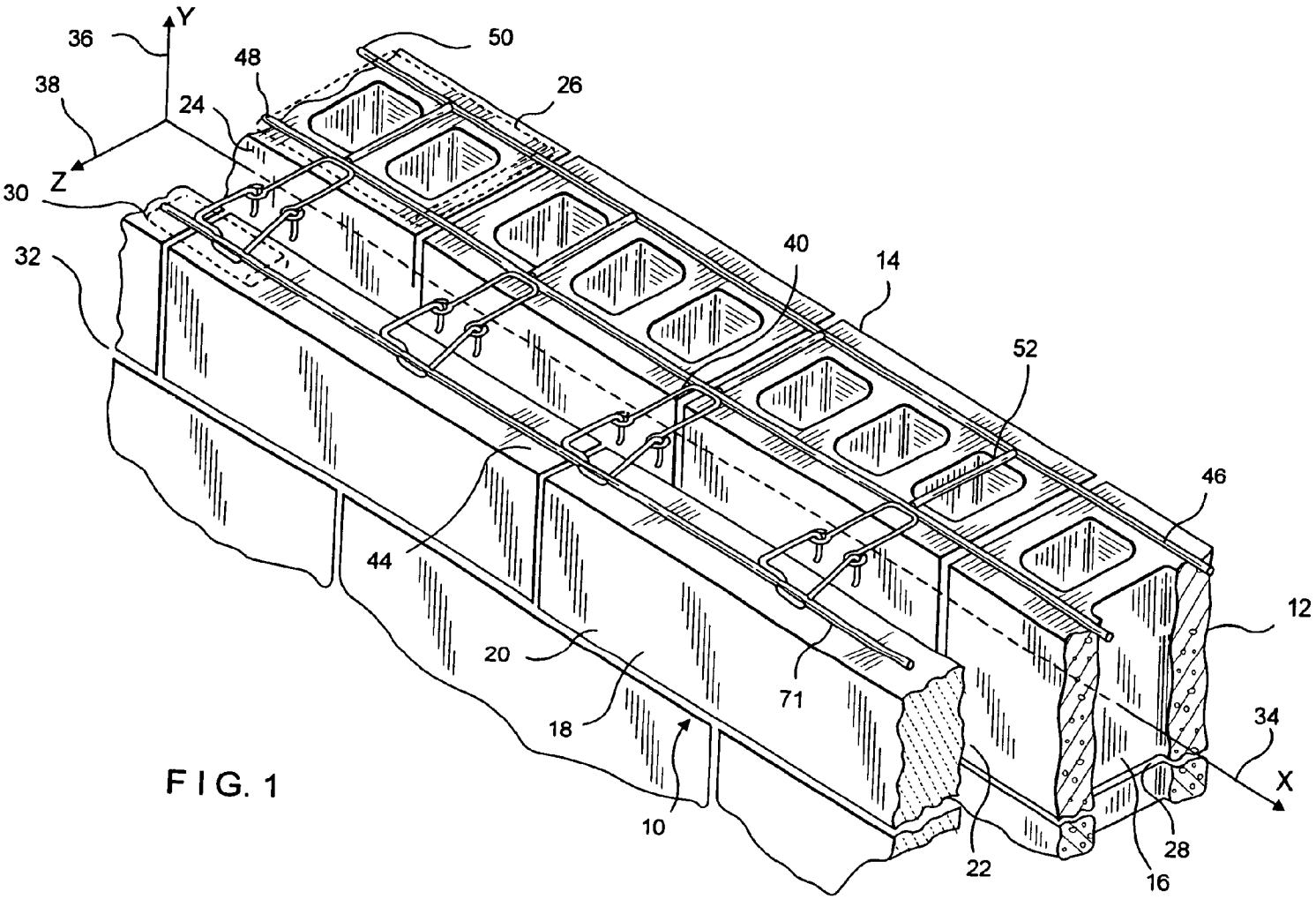
FIG. 1 is a perspective view of a first embodiment of a snap-in wire tie system of this invention, including a side-welded, wall anchor and shows a wall with an inner wythe of masonry block and an outer wythe of brick veneer.

Referring now to FIGS. 1 and 3, the first embodiment of the snap-in wire tie system including a seismic wire reinforcement of this invention is shown and is referred to generally by the numeral 10. In this embodiment, a wall structure 12 is shown having a backup wall 14 of masonry blocks 16 and a facing wall or veneer 218 of facing brick or stone 20. Between the backup wall 14 and the facing wall 18, a cavity 22 is formed, which cavity 22 extends outwardly from surface 24 of backup wall 14.

In this embodiment, successive bed joints 26 and 28 are formed between courses of blocks 16 and the joints are substantially planar and horizontally disposed. Also, successive bed joints 30 and 32 are formed between courses of facing brick 20 and the joints are substantially planar and horizontally disposed. For each structure, the bed joints 26, 28, 30 and 32 are specified as to the height or thickness of the mortar layer and such thickness specification is rigorously adhered to so as to provide the uniformity inherent in quality construction. Selected bed joint and bed joint 30 are constructed to align, that is to be substantially coplanar, the one with the other.

For purposes of discussion, the exterior surface 24 of the backup wall 14 contains a horizontal line or x-axis 34 and an intersecting vertical line or y-axis 36. A horizontal line or z-axis 38, normal to the xy-plane, also passes through the coordinate origin formed by the intersecting x- and y-axes. In the discussion which follows, it will be seen that the various anchor structures are constructed to restrict movement interfacially—wythe vs. wythe—along the z-axis and, in this embodiment, along the x-axis. The device 10 includes a wall anchor 40 constructed for embedment in bed joint 26, which, in turn, includes two legs 42 extending into cavity 22. Further, the device 10 includes a wire formative veneer tie or anchor 44 for embedment in bed joint 30. In order to meet seismic requirements, a continuous wire reinforcement, described infra., is included in the seismic system hereof.

The wall anchor 40 is shown in FIGS. 1 and 2 as being emplaced on a course of blocks 16 in preparation for embedment in the mortar of bed joint 26. In the best mode of practicing this embodiment, a ladder-type wall reinforcement wire portion 46 is constructed of a wire formative with two parallel continuous straight wire members 48 and 50 spaced so as, upon installation, to each be centered along the outer walls of the masonry blocks 16. Intermediate wire bodies or cross rods 52 are interposed therebetween and connect wire members 48 and 50 forming rung-like portions of the ladder structure 46.

At intervals along the wall reinforcement 46, spaced pairs of transverse wire members 54 are attached thereto and are attached to each other by a rear leg 56 therebetween. These pairs of wire members 54 extend into cavity 22 to snap-in wire tie 44. As will become clear by the description which follows, the spacing between the transverse wire member 54 is constructed to limit the x-axis movement of the construct. Each transverse wire member 54 has at the end opposite the attachment end an eye wire portion 58 formed contiguous therewith.

Upon installation, the eye 60 of eye wire portion 58 is constructed to be within a substantially horizontal plane normal to exterior surface 24. The eye 60 is dimensioned to accept a pintle of the wire tie or veneer anchor 44 therethrough and has a slightly larger diameter than that of the anchor. This relationship minimizes the movement of the construct in an xz-plane. For positive engagement, the eye 60 of eye wire portion 58 is sealed forming a closed loop.

The snap-in wire tie 44 is, when viewed from a top or bottom elevation, generally U-shaped and is dimensioned to be accommodated by the pair of eye wires 58 previously described. The anchor 44 has two rear leg portions or pintles 62 and 64, two parallel side leg portions 66 and 68, and a front leg portion 70, which have been compressively reduced in height. The front leg portion 70 accommodates continuous wire reinforcement member 71 which is threaded through swaged indentations 73 and 75.

As shown in FIG. 3, swaged indentation 73 is formed in the surface of side leg 66 so that, upon installation, the reinforcing wire 71 placed therein snaps firmly into place prior to being embedded in bed joint 30. Also as shown in FIG. 3, swaged indentation 75 is formed in the surface of front leg 70 so that, upon installation, the continuous reinforcing wire 71 placed therein snaps firmly into place prior to being embedded in bed joint 30. Although the swaged indentations 73 and 75 are described as shown, the function of the veneer anchor 44 would be the same if the indentations were in side leg 68. The longitudinal axes of leg portions 66, 68 and 70 are substantially coplanar. The pintles 62 and 64 are dimensioned to function cooperatively with the eyes 60 of eye wire portions 58 and thereby limits the movement of the construct in an xz-plane. It is within the contemplation of this invention that the eyes 60 may be slightly elongated in the direction to accommodate the tolerance during seating of the reinforcing wire 71.

In this embodiment, indentations 73 and 75 are swaged into leg portions 66 and 68, respectively, which indentations are dimensioned to accommodate and cradle continuous reinforcing wire 71. With the reinforcing wire 71 installed in a snap-fit relationship in anchor 44 as described, the anchoring system meets building code requirements for seismic construction and the wall structure conforms to the testing standards therefor.

The above-described arrangement of wire formatives has been strengthened in several ways. First, in place of the standard 9-gage (0.148-inch diameter) wall reinforcement wire, a 3/16-inch (0.187-inch diameter) wire is optionally used throughout. Here, wall reinforcement 46, wall anchor 40, the veneer tie 44, and veneer reinforcing wire 71 are all formed from 0.187-inch diameter wire. The snap fit of this invention requires a force of 5 to 10 lbs. to fully seat the reinforcing wire within the snap-in housing of the wire tie 44.

Figures 4, 5:
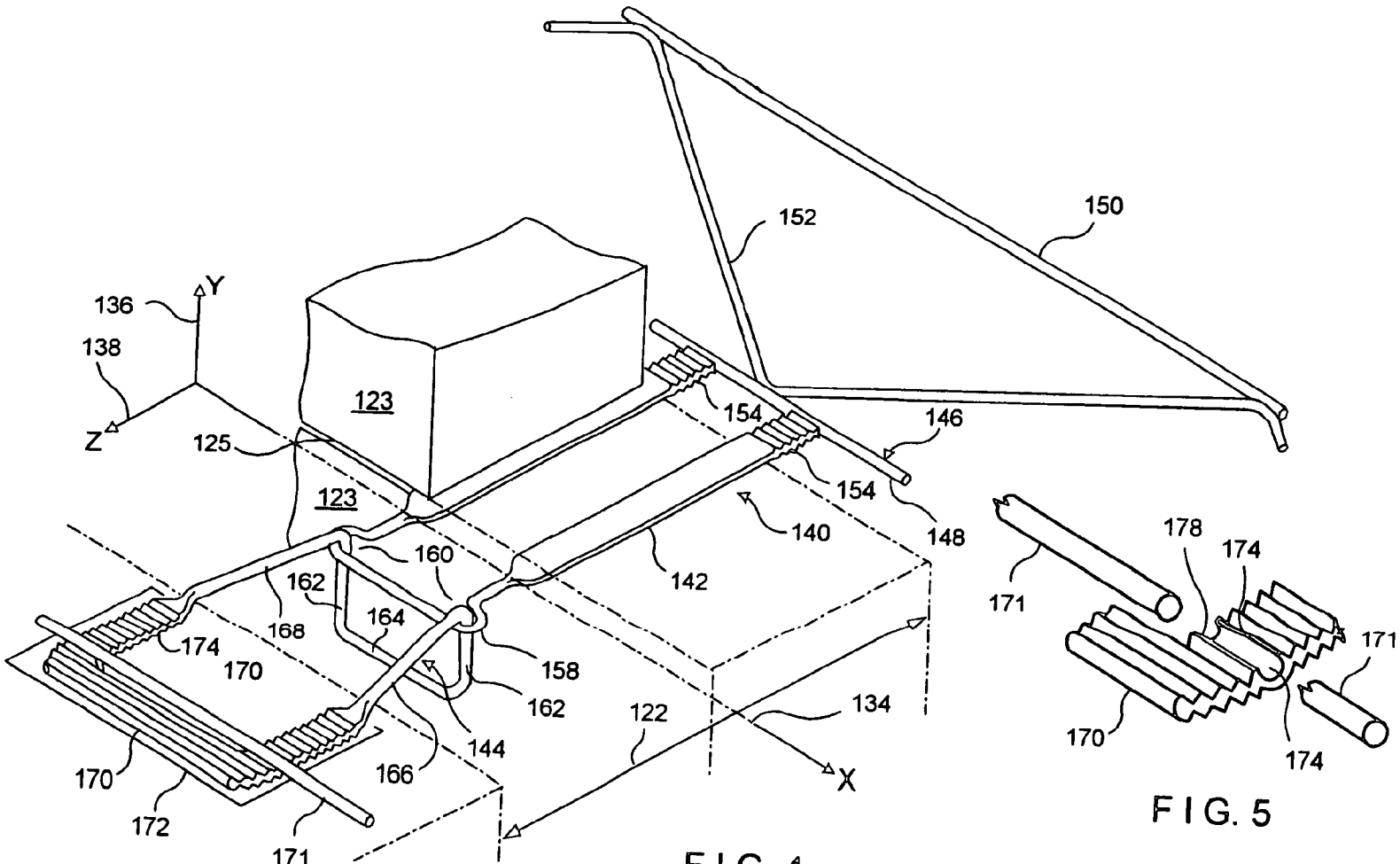
FIG. 4 is a partial perspective view of a second embodiment of a snap-in wire tie for a seismic construction system and includes a backup wall truss-type reinforcement with a low-profile, high-span wall anchor with a T-type horizontal opening and a bent-box, snap-in wire tie.
FIG. 5 is a partial perspective view of FIG. 4 showing details of the bent box, snap-in wire tie.

The description which follows is of a second embodiment of the snap-in wire tie. In this embodiment the wall anchor portion is adapted from the high-span anchor and wall reinforcement device of U.S. Pat. No. 6,668,505 by the above-named inventors. For ease of comprehension, where similar parts are used reference designators "100" units higher are employed. Thus, the wire tie 144 of the second embodiment is analogous to the wire tie 44 of the first embodiment. Referring now to FIG. 4, the second embodiment of a snap-in wire tie of this invention is shown and is referred to generally by the numerals 140 for the wall anchor, 144 for the wire tie, and 146 for the backup wall reinforcement. As this embodiment is similar to the first embodiment, the wall structure is not shown, but the wall structure of FIG. 1 is incorporated herein by reference.

The backup wall is insulated with strips of insulation 123 attached to the cavity surface of the backup wall and has seams 125 between adjacent strips coplanar with adjacent bed joints. In this embodiment, the cavity 122 is larger-than-normal and has a 5-inch span.

For purposes of discussion, the exterior surface of the insulation 125 contains a horizontal line or x-axis 134 and an intersecting vertical line or y-axis 136. A horizontal line or z-axis 138, normal to the xy-plane, also passes through the coordinate origin formed by the intersecting x- and y-axes.

The wall anchor 140 is shown in FIG. 4 as having an insulation-spanning portion or extension 142 for interconnection with wire tie 144. In this embodiment, a truss-type wall reinforcement 146 is constructed of a wire formative with two parallel continuous straight side wire members 148 and 150 spaced so as, upon installation, to each be centered along the outer walls of the masonry blocks. An intermediate wire body 152 is interposed therebetween and is butt welded to wire members 148 and 150, thus separating and connecting side wires 148 and 150 of reinforcement 146.

At intervals along the truss-type reinforcement 146, spaced pairs of transverse wire members 154 are attached by electric resistance welding in accord with ASTM Standard Specification A951. These pairs of wire members 154 extend into the cavity 122. The spacing therebetween limits the x-axis movement of the construct. Each transverse wire member 154 has at the end opposite the attachment end a T-head portion 158 formed continuous therewith. Upon installation, the T-head opening or throat 160 is constructed to be within a substantially horizontal or xz-plane, which is normal to the cavity walls. The T-head throat 160 is horizontally aligned to accept the downwardly bent portion 162 of snap-in wire tie 144 threaded therethrough. The T-head throat 160 is slightly wider than the bent portion of the tie and the diameter of the wire of the bent portion fits snugly therewithin. These dimensional relationships minimize the x- and z-axis movement of the construct. For ensuring engagement, the bent portion of wire tie 144 is available in a variety of lengths.

The snap-in wire tie 144 is a low-profile wire formative, and, when viewed from a top or bottom elevation, generally box-shaped. The low-profile wall tie 144 is dimensioned to be accommodated by T-head portion 158 described, supra. The wire tie 144 has two downwardly bent leg portions 162 and a connecting rear leg 164, two substantially parallel side leg portions 166 and 168, which are substantially at right angles and attached to the leg portions 162 and 164, respectively, and a front leg portion 170. An insertion portion 172 of veneer tie 144, upon installation extends beyond the cavity 122 into the bed joint of the facing wall (not shown). This portion includes front leg portion 170 and part of side leg portions 166 and 168. The longitudinal axes of side leg portions 166 and 168 and the longitudinal axis of the front leg portion 170 are substantially coplanar.

In the second embodiment in adapting the snap-in wire tie for high-span applications, it is noted that the above-described arrangement of wire formatives is strengthened in several respects. First, in place of the standard 9-gage (0.148-inch diameter) wall reinforcement wire, a 3/16-inch (0.187-inch diameter) wire is used. Additionally a 0.250-inch wire is used to form both the wall anchor 140 and the veneer anchor 144. Here the insertion ends of only the wall anchor 140 and the snap-in wire tie 144 are compressively reduced in height. In this regard, wall anchor 140 is reduced by up to 70%, but at least by the amount required to be within the envelope of wall reinforcement 146. Thus, upon butt welding the height is not increased.

Also, the successive insulation strips 123 when in an abutting relationship the one with the other are sufficiently resilient to seal at seam 125 without air leakage therebetween. The extended insulation-spanning portions 142 of wall anchor 140 are flattened. This results in minimal interference with the seal at seam 125.

Upon compressing the insertion ends of wall anchors 140 and 144, a corrugated pattern is optionally impressed thereon. The ridges and valleys of the corrugations 176 are shown in FIG. 9 and are impressed so that, upon installation, the corrugations 176 are parallel to the x-axis 134. In FIG. 5, a detail of the snap-in housing 174 is shown. Here the continuous reinforcement wire 171 is broken away and the clamping jaws 176 and 178 are shown. The snap fit of this embodiment requires a slightly firmer insertion force than in the first embodiment occurring in the 7 to 12 lb. range.

The insertion portion 172 of veneer tie 144 is considerably compressed and, while maintaining the same mass of material per linear unit as the adjacent wire formative, the vertical height is reduced. The vertical height of insertion portion 172 is reduced so that, upon installation, mortar of bed joint flows around the insertion portion 172. Upon compression, a pattern or corrugation is impressed on either or both of the upper and lower surfaces of insertion portion 172. When the mortar of bed joint flows around the insertion portion, the mortar flows into the valleys of the corrugations. The corrugations enhance the mounting strength of the veneer tie 144 and resist force vectors along the z-axis 138. With veneer tie 144 compressed as described, the veneer tie is characterized by maintaining substantially all the tensile strength as prior to compression. A variant of the second embodiment for a drywall inner wythe employs a T-LOK tie wall anchor as described in U.S. Pat. No. 5,816,008 of Ronald P. Hohmann and manufactured by Hohmann and Barnard, Inc., Hauppauge, N.Y. 11788.

The description which follows is of a third embodiment of the snap-in wire tie system. For ease of comprehension, where similar parts are used reference designators "200" units higher are employed. Thus, the wall tie 244 of the third embodiment is analogous to the wall tie 44 of the first embodiment.

Figure 6:
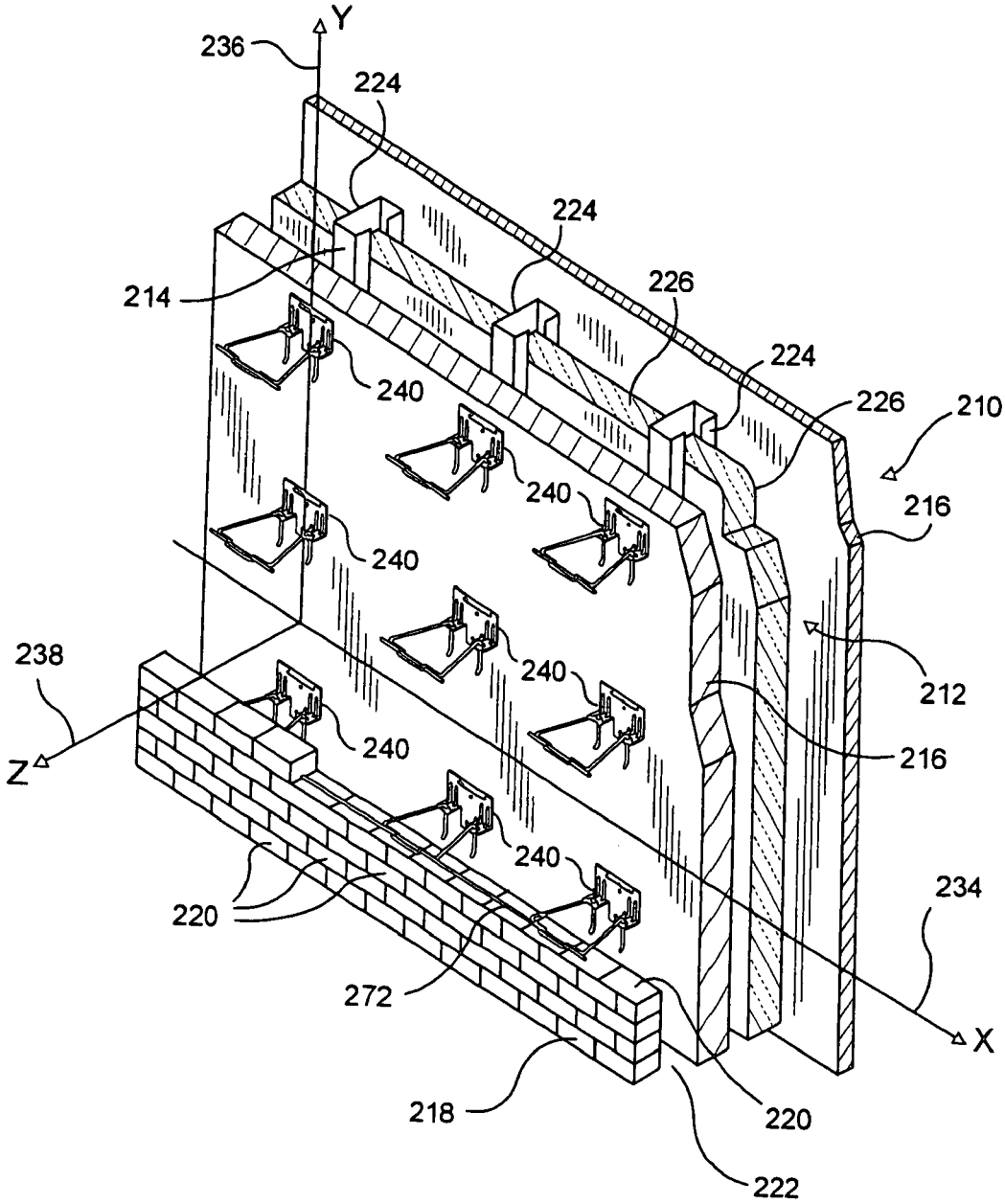
FIG. 6 is a perspective view of a third embodiment of a snap-in wire tie of this invention providing for seismic reinforcement of a cavity wall structure, wherein the building system therefor includes a wall anchor for a drywall inner wythe, an interlocking snap-in wire tie, and a continuous wire reinforcement.
Figure 7:
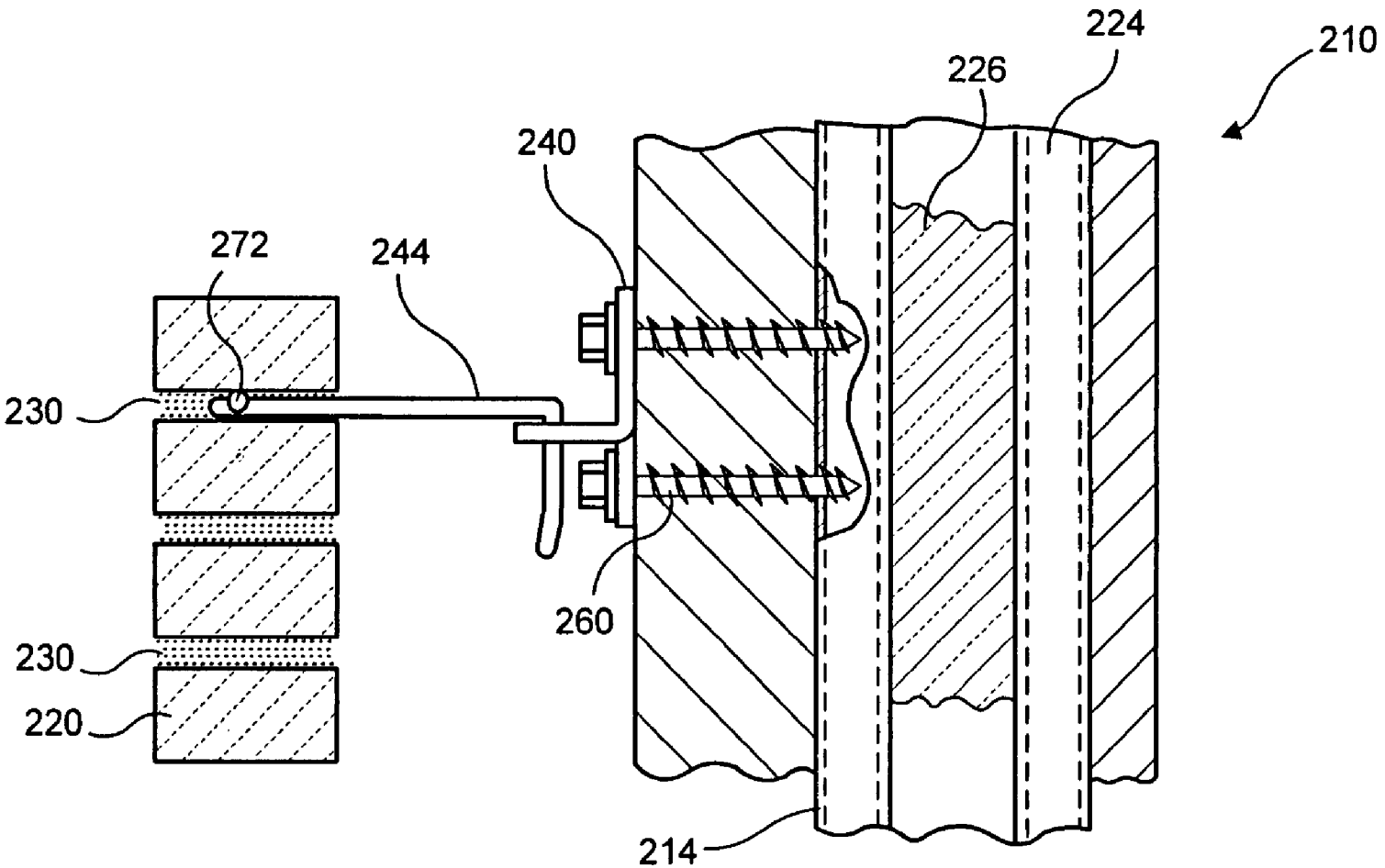
FIG. 7 is a cross-sectional view of FIG. 6 taken along a yz-plane that includes the longitudinal axis of one leg of the snap-in wire tie; and, FIG. 8 is a partial perspective view of FIG. 6 showing details of the wall anchor, the snap-in wire tie, and the continuous wire-reinforcement.
Figure 8:
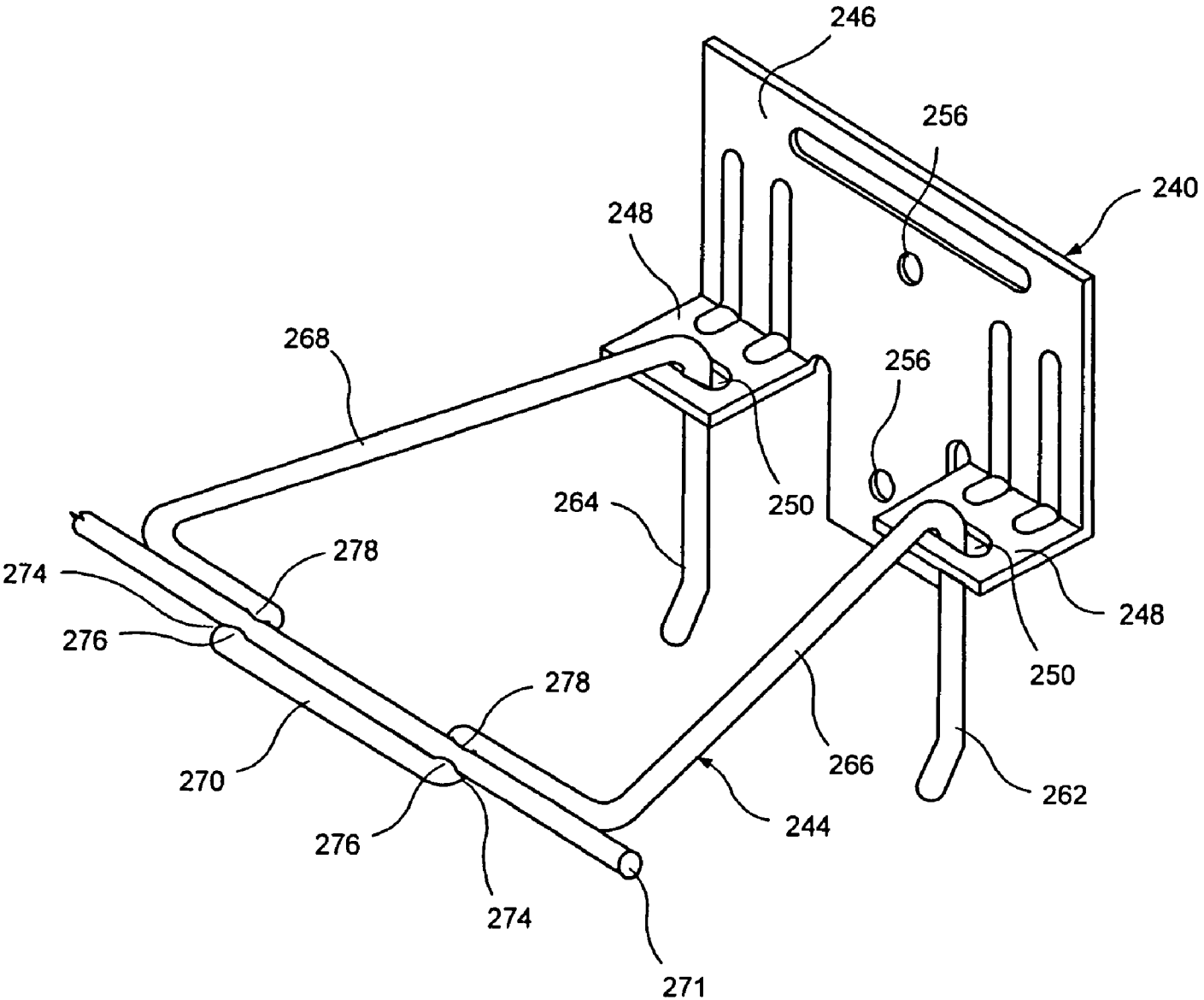

Referring now to FIGS. 6 to 8, the third embodiment of the snap-in wire tie system is shown and is referred to generally by the numeral 210. The system 210 employs a sheetmetal wall anchor, Catalog #HB-200. The dry wall structure 212 is shown having an interior or inner wythe 214 with a wallboard 216 as the interior and exterior facings thereof. An exterior or outer wythe 218 of facing brick 220 is attached to dry wall structure 212 and a cavity 222 is formed therebetween. The dry wall structure 212 is constructed to include, besides the wallboard facings 16, vertical channels 224 with insulation layers 226 disposed between adjacent channel members 224. Selected bed joints 228 and 230 are constructed to be in cooperative functional relationship with the snap-in wire tie described in more detail below. For purposes of discussion, the exterior surface 232 of the interior wythe 214 contains a horizontal line or x-axis 234 and an intersecting vertical line or y-axis 236. A horizontal line or z-axis 238 also passes through the coordinate origin formed by the intersecting x- and y-axes. The system 210 includes a dry wall anchor 240 constructed for attachment to vertical channel members 224, an insertion portion 272, constructed for embedment in joint 228 and an interconnecting snap-in wire tie member 244.

Reference is now directed to the construction of the wall anchor 240 comprising a backing or base plate member 246 and projecting pintle-receiving receptor portions 248. The projecting receptor portions 248 are punched-out from the base plate member 246 so as to have, upon installation, horizontally disposed apertures which, as best seen in FIG. 8, provide a pair of wire-tie-receiving apertures 250. The apertures are substantially circular configurations and are formed in plate members 248. Upon installation the projecting portions 248 are thus disposed substantially at right angles with respect to the plate member 246. To ease tolerance stack up apertures 250 may be slightly elongated along the z-axis thereof. The plate member 246 is also provided with mounting holes 256 at the upper and lower ends thereof.

As is best seen in FIG. 8, the projecting pintle-receiving portions 248 are spaced from the plate member 246 and are adapted to receive the pintles of snap-in wire tie 244 therewithin. In the fabrication of the dry wall as the inner wythe of this construction system 210, the channel members 224 are initially secured in place. In this regard, the channel members 224 may also comprise the standard framing members of a building. Sheets of exterior wallboard 216, which may be of an exterior grade gypsum board, are positioned in abutting relationship with the forward flange 258 of the channel member 224. While the insulating layer has herein been described as comprising a gypsum board, it is to be noted that any similarly suited rigid or flexible insulating material may be used herein with substantially equal efficacy.

After the initial placement of the flexible insulation layer 226 and the wallboard 216, the veneer anchors 240 are secured to the surface of the wallboard 216 in front of channel members 224. The sheetmetal Catalog # HB-200 (Hohmann & Barnard, Inc., Hauppauge, N.Y. 11788). Thereafter, sheetmetal screws 260 are inserted into the mounting holes 256 to fasten the anchor 240 to the flange 258 and to channel member 224.

The wire tie 244 is, when viewed either as a top or bottom elevation is substantially a U-shaped member and is dimensioned to be accommodated within apertures 250 previously described. The wire tie 244 has a wall-anchor-connection portion having two rear leg portions or pintles 262 and 264, two substantially parallel side leg portions 266 and 268, and a front leg portion 270. The rear leg portions or pintles 262 and 264 are spaced apart by the spacing between apertures 250 of the projecting pintle-receiving portions 248. The longitudinal axes of leg portions 266, 268 and 270 are substantially coplanar. The rear leg portions 262 and 264 are structured to function cooperatively with the sizing of the apertures 250 of the projecting portions 248 to limit side-to-side movement along the x-axis and minimize movement toward and away from the inner wythe 214 along the z-axis of the construct. The projecting pintle-receiving receptor portions 248 and the pair of wire-tie-receiving apertures 250 of the wall anchor 240 may be modified (not shown) to accept snap-in wire ties similar to that shown in the first embodiment 44 as well as that shown in the second embodiment 144. Such modifications allow for similar specialized snap-in wire ties 44 and 144 to be used in a dry wall structure.

The projecting pintle-receiving portions 248 and the pair of wire-tie-receiving receptors 250 of the wall anchor 240 may be modified (not shown) to accept snap-in wire ties similar to that shown in the first embodiment 44 as well as that shown in the second embodiment 144. Such modifications allow for similar specialized snap-in wire ties 44 and 144 to be used in a dry wall structure.

The front leg portion 270 has been configured, as will be seen in the description that follows, to accommodate therewithin in a snap-fit relationship the reinforcement wire or straight wire member 271 of predetermined diameter. The front leg portion 270 is attached to and is contiguous with side leg portions 266 and 268 and is structured to underlie the reinforcement wire while exerting a clamping pressure thereon. The anchoring system hereof meets building code requirements for seismic construction and the wall structure reinforcement of both the inner and outer wythes exceeds the testing standards therefor. In contradistinction to the first embodiment, the front leg portion 270 is disposed on both sides of the reinforcing wire 271 and has two snap-in housings 274 impressed therein. Each housing 274 have a pair of clamping jaws 276 and 278 which are spaced to require an insertion force of from 5 to 10 lbs. With this configuration the bed joint 228 height specification is readily maintained. As differentiated from the first two embodiments, the dry wall construction system 210 provides for the structural integrity by the securement of the veneer anchor construction to the channel member.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A seismic construction system for use in the construction of wall structures having an inner wythe and an outer wythe in a spaced apart relationship forming a cavity therebetween, said inner wythe is a drywall structure having wallboard facings disposed on vertical channel members, said system comprising, in combination:

a sheet metal wall anchor adapted to be secured by surface mounting on said wallboard facing, said wall anchor in turn, comprising:

at least one receptor portion extending opposite said inner wythe, each receptor attached thereto extending into said cavity and terminating therewithin;

a receiving aperture in each receptor portion and, upon installation, said receptor portion installed in said wall structure disposed in said cavity;

a snap-in wire tie adapted for embedment in said outer wythe, said snap-in wire tie comprising:

a wall-anchor-connector portion being disposed in said at least one receptor portion;

an insertion portion continuous with said wall-anchor-connector portion;

at least two wire housings formed in said insertion portion comprising:

a clamping jaw in each of said at least two wire housings for securely clamping a wire disposed therein in a snapped-in relationship, said clamping requiring an insertion force of from 5 to 10 lbs; and, at least one reinforcement wire disposed longitudinally in said outer wythe and securely clamped within said wire housings of said snap-in wire tie;

whereby, a seismic construct is formed upon securement of said wall anchor to said inner wythe with said snap-in wire tie disposed in said receptor portion thereof and upon the embedment of said insertion portion of said snap-in wire tie and said reinforcement wire in the outer wythe.

2. A seismic construction system as described in claim 1 wherein each said receptor portion is a pintle-receiving aperture and, upon installation, said aperture is disposed in horizontally extending projections.

3. A seismic construction system as described in claim 2 wherein each wall-anchor-connector portion is a pintle.

4. A seismic construction system as described in claim 3 wherein each said pintle is a wire formative and each said receiving aperture is dimensioned to minimize movement towards and away from said inner wythe and limit side-to-side movement.

5. A seismic construction system as described in claim 1 wherein said snap-in wire tie has a rear leg, said rear leg for interlocking with said receptor portion.

6. A seismic construction system as described in claim 1 wherein said sheet metal wall anchor is a metal stamping.

7. A seismic construction system as described in claim 1 wherein said sheet metal wall anchor is attached to said vertical channel members of said inner wythe by sheet metal screws.

8. A seismic construction system for use in the construction of wall structures having an inner wythe and an outer wythe in a spaced apart relationship forming a cavity therebetween, said inner wythe is a masonry structure with insulation thereon having a thickness requiring a high-span cavity, said system comprising, in combination:

a sheet metal wall anchor adapted to be secured by surface mounting on said masonry structure, said sheet metal wall anchor in turn comprising:

at least one receptor portion extending opposite said inner wythe into said cavity and terminating therewithin;

a receiving aperture in each said receptor portion and, upon said installation, said receptor portion installed in said wall structure disposed horizontally in said cavity;

a snap-in wire tie adapted for embedment in said outer wythe, said snap-in wire tie comprising:

a wall anchor-connector-portion being disposed in said at least one receptor portion;

an insertion portion continuous with said wall-anchor-connector portion;

at least two wire housings formed in said insertion portion comprising:

a clamping jaw in each of said at least two wire housings for securely clamping a wire therein in a snapped-in relationship, said clamping requiring an insertion force of from 5 to 10 lbs; and at least one reinforcement wire disposed longitudinally in said outer wythe and securely clamped within said wire housings of said snap-in wire tie;

whereby, a seismic construct is formed upon securement of said wall anchor to said inner wythe, with said snap-in wire tie disposed in said receptor portion thereof and upon the embedment of said insertion portion of said snap-in wire tie and said reinforcement wire in the outer wythe.

9. A seismic construction system as described in claim 8 wherein each said receptor portion is a pintle-receiving aperture and, upon installation, each said aperture is disposed in horizontally extending projections.

10. A seismic construction system as described in claim 9 wherein each wall-anchor-connector portion is a pintle.

11. A seismic construction system as described in claim 10 wherein each said pintle is a wire formative and each said receiving aperture is dimensioned to minimize movement towards and away from said inner wythe and limit side-to-side movement.

12. A seismic construction system as described in claim 8 wherein said snap-in wire tie has a rear leg, said rear leg for interlocking with said receptor portion.

13. A seismic construction system as described in claim 8 wherein said sheet metal wall anchor is a metal stamping.

14. A seismic construction system as described in claim 8 wherein said sheet metal wall anchor is attached to said masonry structure of said inner wythe by masonry screws.

15. A seismic construction system as described in claim 8 wherein said insertion portion is a wire formative.

* * * * *